US008002650B2

(12) United States Patent
Altenburger et al.

(10) Patent No.: US 8,002,650 B2
(45) Date of Patent: Aug. 23, 2011

(54) PLAY AND SPORT DEVICE FOR LOBBING AND CATCHING A FLYING OBJECT, WHICH CAN BE PLAYED USING ONE HAND

(76) Inventors: Gregor Altenburger, Zurich (CH); Urs Robustelli, Zurich (CH)

( * ) Notice: Subject to any disclaimer, the term of this patent is extended or adjusted under 35 U.S.C. 154(b) by 88 days.

(21) Appl. No.: 12/374,465

(22) PCT Filed: Jul. 19, 2007

(86) PCT No.: PCT/CH2007/000356

§ 371 (c)(1),
(2), (4) Date: Jan. 20, 2009

(87) PCT Pub. No.: WO2008/017174

PCT Pub. Date: Feb. 14, 2008

(65) Prior Publication Data

US 2009/0318250 A1 Dec. 24, 2009

(30) Foreign Application Priority Data

Aug. 5, 2006 (CH) ..... 1252/06

(51) Int. Cl.
*A63B 59/00* (2006.01)
*A63B 65/12* (2006.01)

(52) U.S. Cl. ..... 473/510

(58) Field of Classification Search ..... 473/518, 473/511, 510, 508, 505, 475, 507, 509, 512; 124/79

See application file for complete search history.

(56) References Cited

U.S. PATENT DOCUMENTS

| | | | | | |
|---|---|---|---|---|---|
| 1,156,047 | A | * | 10/1915 | Behrend | 473/511 |
| 1,463,726 | A | * | 7/1923 | Ruttmann | 473/511 |
| 1,558,666 | A | * | 10/1925 | Brewer et al. | 473/518 |
| 1,808,035 | A | * | 6/1931 | Guenard | 473/532 |
| 2,159,972 | A | * | 5/1939 | Larson | 441/58 |
| 2,224,453 | A | * | 12/1940 | Hansen | 473/511 |
| 2,465,808 | A | * | 3/1949 | Killam | 473/511 |
| 2,835,494 | A | * | 5/1958 | Hull | 473/511 |
| 3,342,491 | A | * | 9/1967 | Padovani | 473/511 |
| 4,162,072 | A | * | 7/1979 | Schultze et al. | 473/511 |
| 4,665,561 | A | * | 5/1987 | Aoki | 2/19 |

FOREIGN PATENT DOCUMENTS

| | | | |
|---|---|---|---|
| DE | 482496 | C | 9/1929 |
| FR | 2338057 | A1 | 8/1977 |
| GB | 191013116 | | 12/1910 |

OTHER PUBLICATIONS

International Search Report for PCT/CH2007/000356.

* cited by examiner

*Primary Examiner* — Gene Kim
*Assistant Examiner* — M Chambers
(74) *Attorney, Agent, or Firm* — Brooks Kushman P.C.

(57) ABSTRACT

Play and sport device in which a flying object can be both lobbed and caught one-handed thanks to a specially constructed diaphragm which is tautened and fastened to the device. The invention can be used both by one player (juggling, wall rebounding, hitting a target) and by two players, as a group or in teams.

10 Claims, 8 Drawing Sheets

PLAY AND SPORT DEVICE FOR LOBBING AND CATCHING A FLYING OBJECT, WHICH CAN BE PLAYED USING ONE HAND

The invention relates to a play and sport device with which relatively small flying objects can be caught and lobbed using one hand (irrespective of being right-handed or left-handed). The device is extremely simple to handle, but the entire range of game options are only opened up by means of skill and practice.

There are some sport and play devices with which flying objects can be lobbed and shot to and from (tennis and badminton racquets and ping-pong bats, etc.). However, the flying object cannot be caught with them. On the other hand, there are catch gloves, Velcro-backed disks, etc. with which a flying object can be caught more easily. However, a flying object cannot be thrown back again therewith, and therefore the other hand has to come to the aid thereof.

Until now, play and sport devices which have been created and with which a flying object can be shot and caught using one hand lack dynamics or the playful element and/or they need electric assistance. This is not the case for the invention cited.

In addition, the present invention provides a surprising effect: it is virtually not apparent to the player/players when the flying object is being lobbed back again, since said flying object is no longer visible after being caught. In addition, the invention cited can be played by one person (juggling, ball rebounding, hitting a target), and by two players, as a group or in teams.

The invention has two embodiments. The core element of both embodiments is a diaphragm for catching and lobbying. If the diaphragm is opened (tensioned), a flying object can be shot. If the diaphragm is closed, a flying object can be caught. The main technical difference between the two embodiments provided is that, with one device, the diaphragm is tensioned by means of hand pressure and, with the other device, the same effect is obtained by opening the hand.

The invention is explained with reference to the attached drawings:

FIG. 1, a view of the diaphragm (1) which is stretched on two curved rods (2) which, in the embodiment of the invention, each form a semicircle (but this is not compulsory). However, the circle is not closed by the rods; in the center of the circle there is a recess (7) which forms the catch pocket and the "elastic spring" for the flying object. The diaphragm is stretched and taken in (4) (or glued, welded) in such a manner that virtually no stretching in the tensioning direction (5) is possible. Stretching in the opposite direction is entirely welcome, since, when catching an object, additional space is thereby created in the diaphragm pocket (but this is only the case if the diaphragm is produced from a material which does not bulge. In addition, the diaphragm is pulled onto the rods in such a manner that the rods are stopped before the recess in the center (catch pocket). Furthermore, at the apex of the tensioning rods, a recess (6) is left free for fastening the same to the play device. Over the length of the fastening, the rods are not bent, but rather are compressed in such a manner that they form two short straight lines (3). A "stopper" (8) is fitted at the apex of the tensioning rods. The "stopper" itself is a simple pin which, together with the holder (36), FIG. 7, has the purpose of preventing the diaphragm from opening up forward. The size of the diaphragm is not fixed, but for the invention cited, probably ranges within a diameter of 15-25 cm.

FIG. 2 shows the first embodiment which is distinguished by the fact that the diaphragm is opened by clenching the hand and closed by means of opening the hand.

The embodiment is based on a bow (9) which, owing to the material used, is easily tensioned (10) and thus always returns to the starting state. This circumstance is assisted by means of a fitted compression spring (11), which is necessary for catching a flying object. The bow is connected fixedly (12-13) to the structure which makes it possible to transmit the pressure to the two moveable "arms" (15) which are used for opening the diaphragm. The location of the force transmission is protected (14). The structure for transmitting the pressure comprises a rack (16) which, by means of its movement, drives the pinions (17) which are connected fixedly to the abovementioned "arms" to which in turn the holders (18) for the tensioning rods are attached. FIG. 2 shows the abovementioned holders which dispense with the "stopper" (8) (according to FIG. 1), since said omission also constitutes a variant for an appropriate playing technique. Apart from that, a diaphragm according to FIG. 1 is used. A special device is not required for holding the embodiment; the bow is simply enclosed by the hand.

FIG. 4 shows a detailed view for the first embodiment (FIG. 2) which illustrates one possible holder (18) which can be used if the "stopper" (8) is dispensed with.

Figure 5:
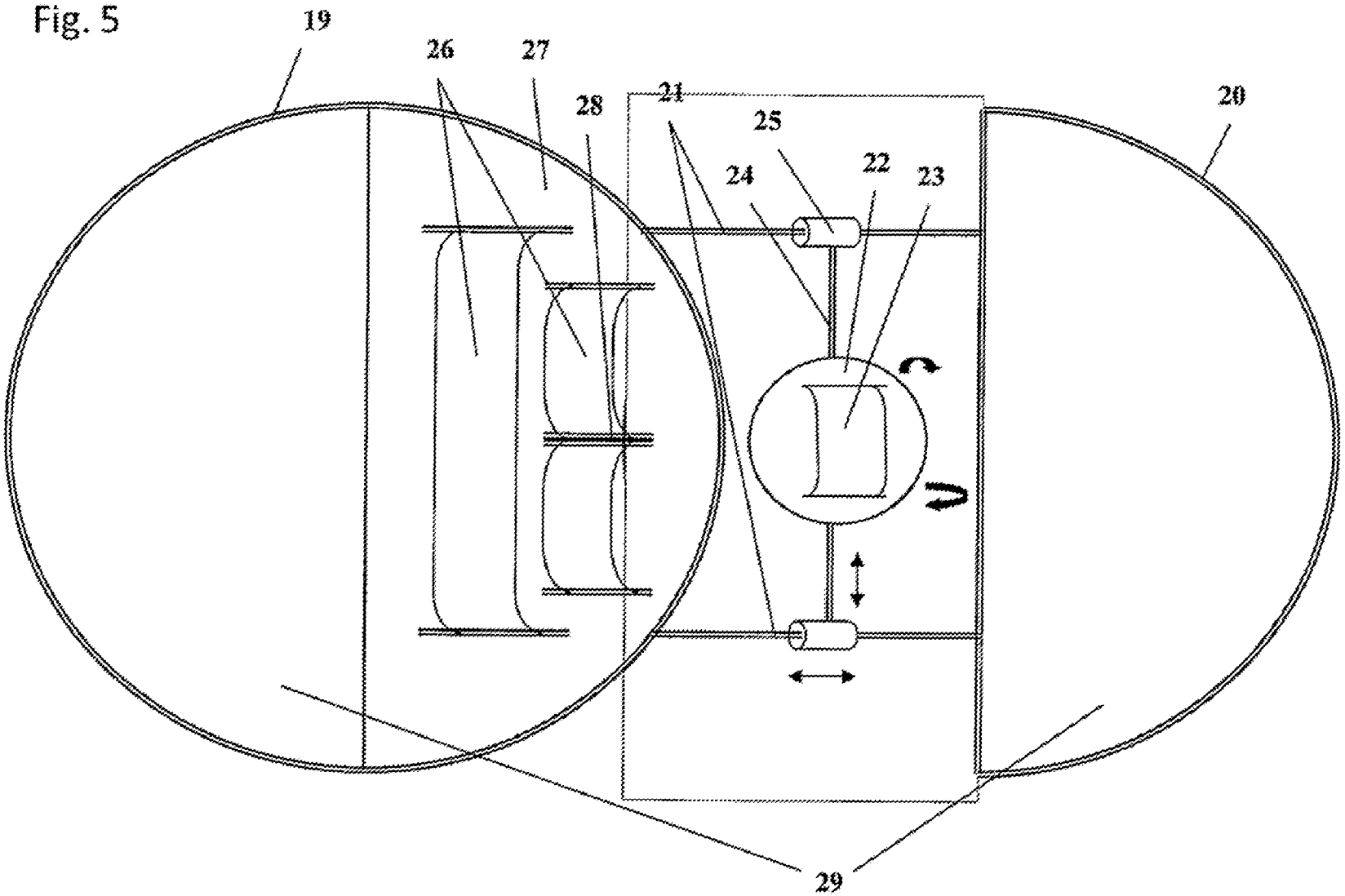

FIG. 5 shows the opened-up front view of the second embodiment which is distinguished by the fact that the diaphragm is opened by opening the hand and closed by means of closing the hand. The basic structure of the embodiment comprises a stable ring (19) on the one side and two guide rods (21) (which are conducted away into a half-ring (20)) on the other side, said guide rods being connected to each other by a hinge (30), FIG. 6. In the second embodiment according to FIG. 5, the thumb and, at minimum, the ring and index fingers are fixed on the device in order to be able to open and close the structure. In this case, the thumb is fixed on a "disk" (22) by means of an adjustable cord (23). The disk in turn sits on a tubular element (38), FIGS. 6 and 7, on a transverse rod (24) which opens into two tubular elements (25), fitted to the abovementioned guide rods in such a manner that the thumb with the "disk" can rotate (ergonomy) and tilt forward and rearward (this makes it possible to be able to open the hand at a greater angle to the device), and to slide along the transverse rod (ergonomy) and the guide rods (transmission of force/speed, ergonomy) (FIG. 7). The other fingers are fastened on a half disk (27) (for example made of plastic, aluminum, etc.) by means of two straps (26), with the lower strap being deflected (28) in the center in such a manner that two openings are produced for the fingers. Greater security on the hand is therefore achieved.

The upper two semicircles (29) of the basic structure from the second embodiment are covered with a highly stretchable material (the stretchability of the material is not compulsory), so that the flying objects can also be played back and forth directly and with the effect of a trampoline.

Figure 6:
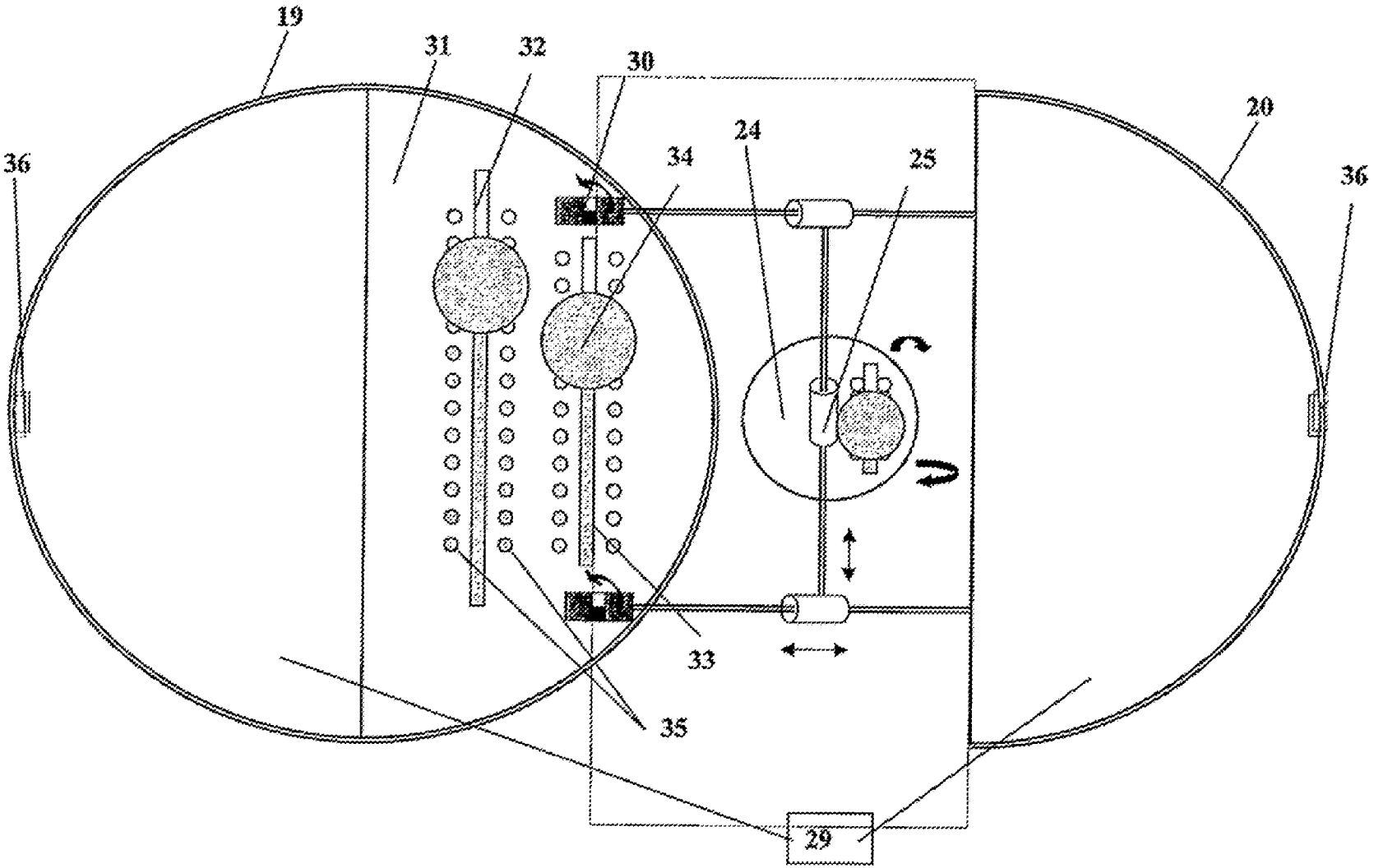
Figure 7:
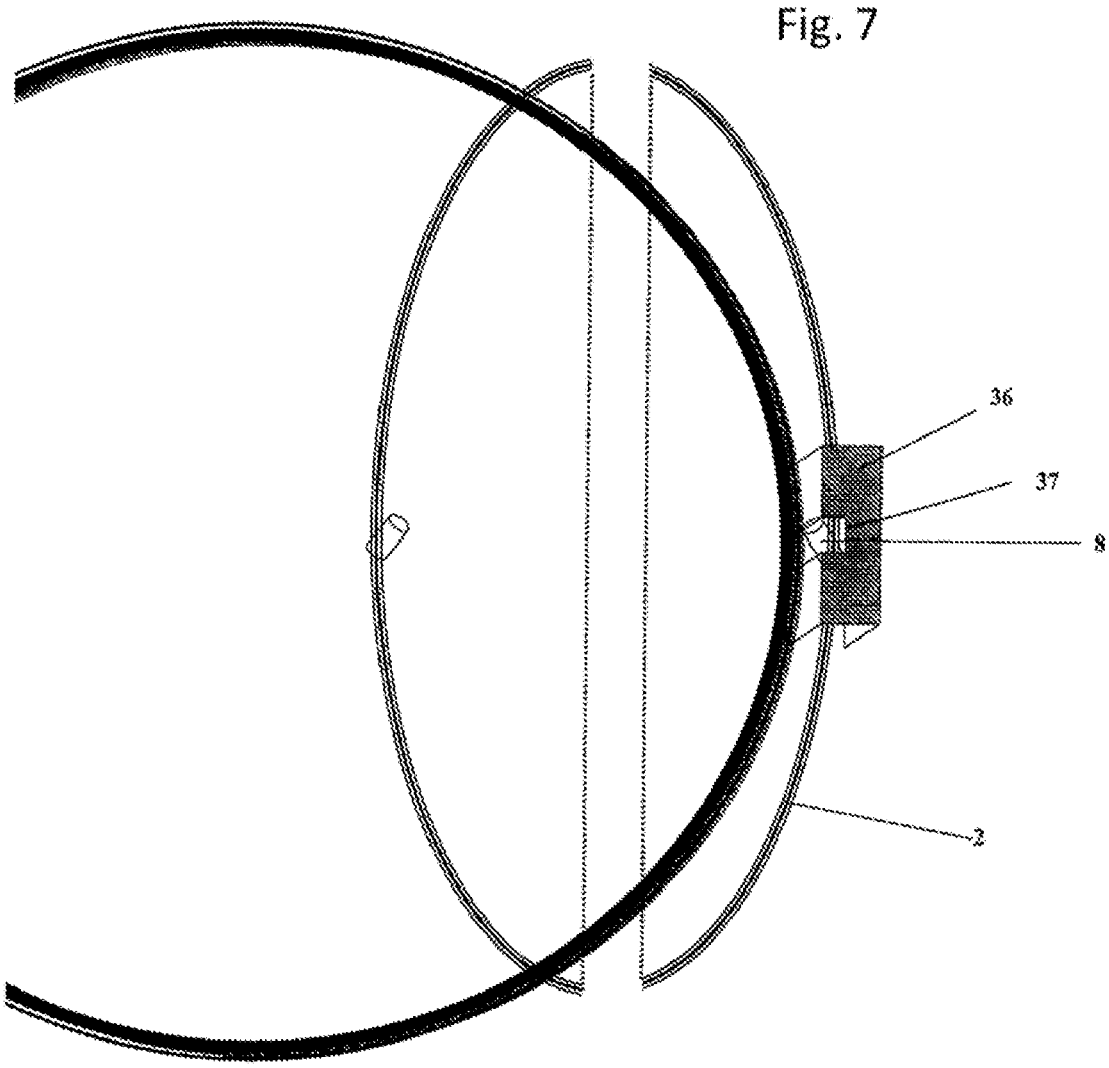

FIG. 6 shows the opened-up rear view of the second embodiment. It also shows the hinges (30) which are described in FIG. 5 and which permit the play device (and the diaphragm) to be opened up and snapped shut. Analogously to FIG. 5 (27), the lower semicircle is a half disk made of plastic (31) (or of aluminum, etc.). The strap for the thumb, and also the straps for the other fingers, are guided in a double base (32) by means of a guide slot (33). They are adjustable by means of a connecting element (34) which is fastened to the straps and can latch, for example, into holes (35) on the rear side of the double wall (31) (or realized with a rapid clamping means, Velcro fastener, etc.).

Figure 1:
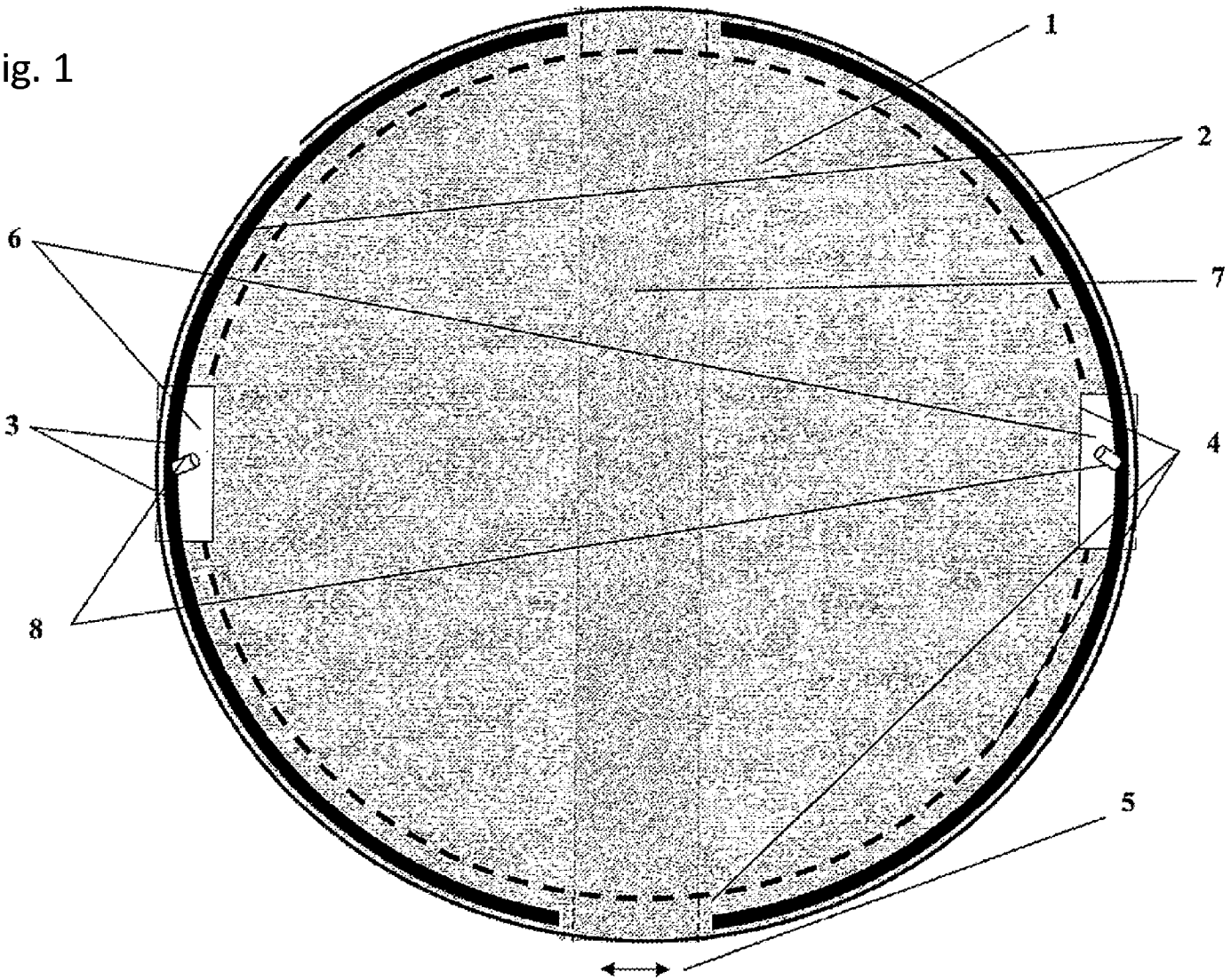
Figure 2:
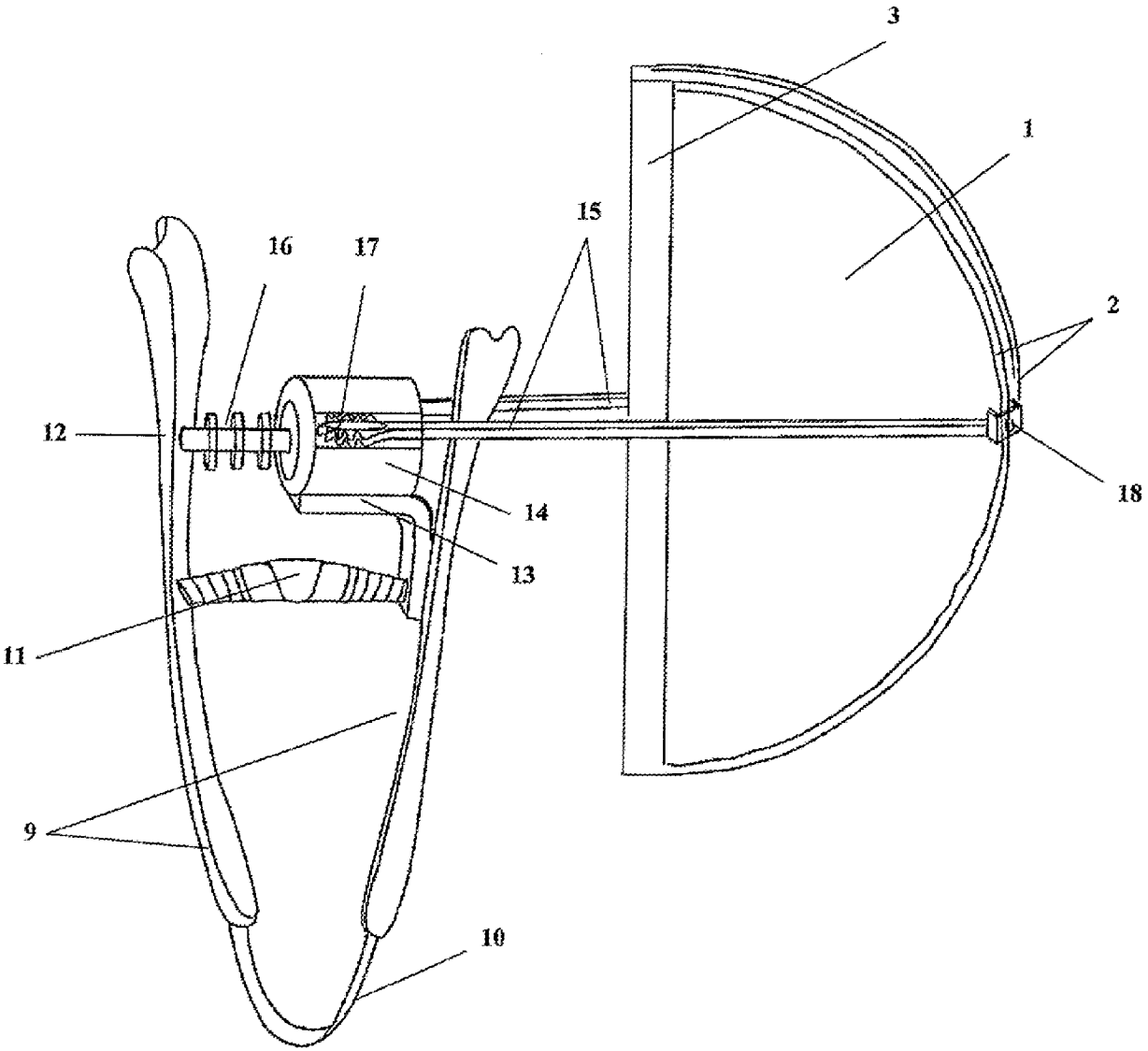
Figure 3:
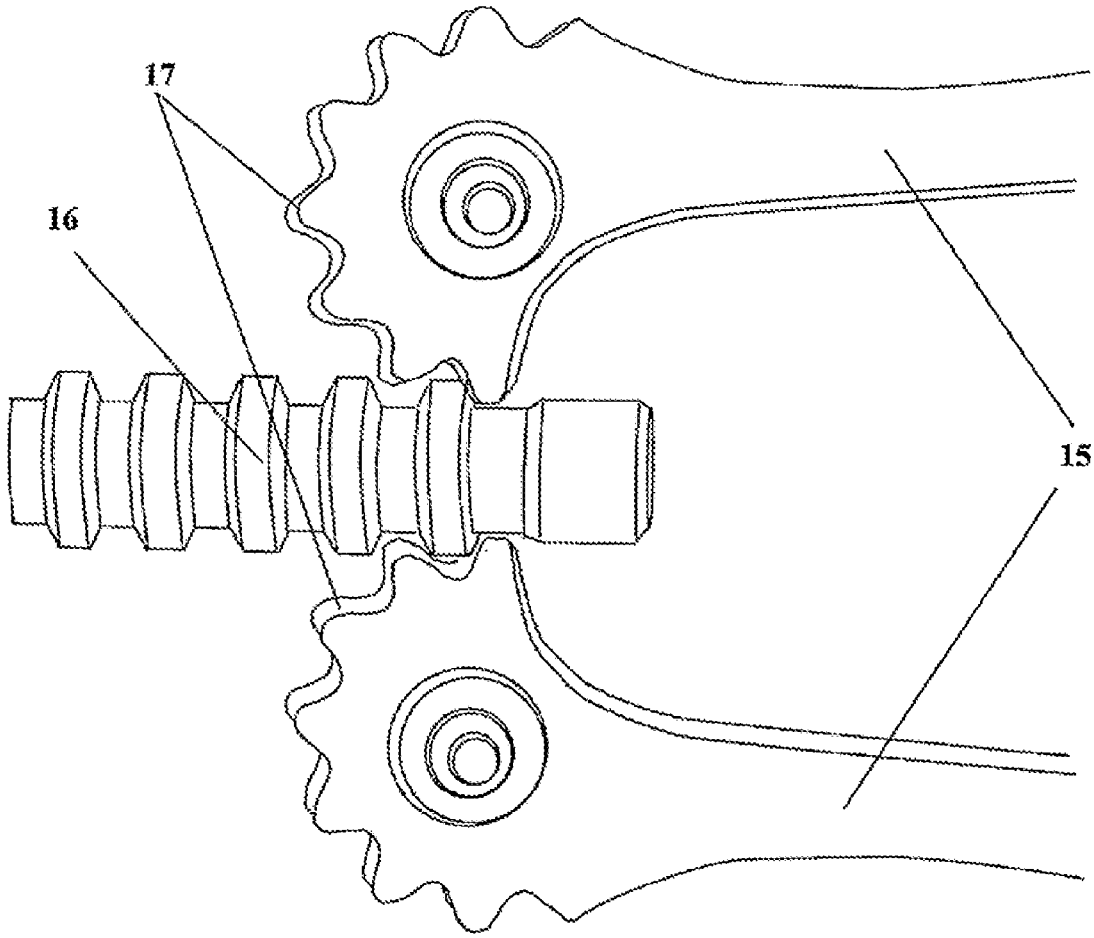
FIG. 3 shows a detailed view of the first embodiment (FIG. 2) in which the technology for transmitting the force and speed is apparent (15-17).
Figure 4:
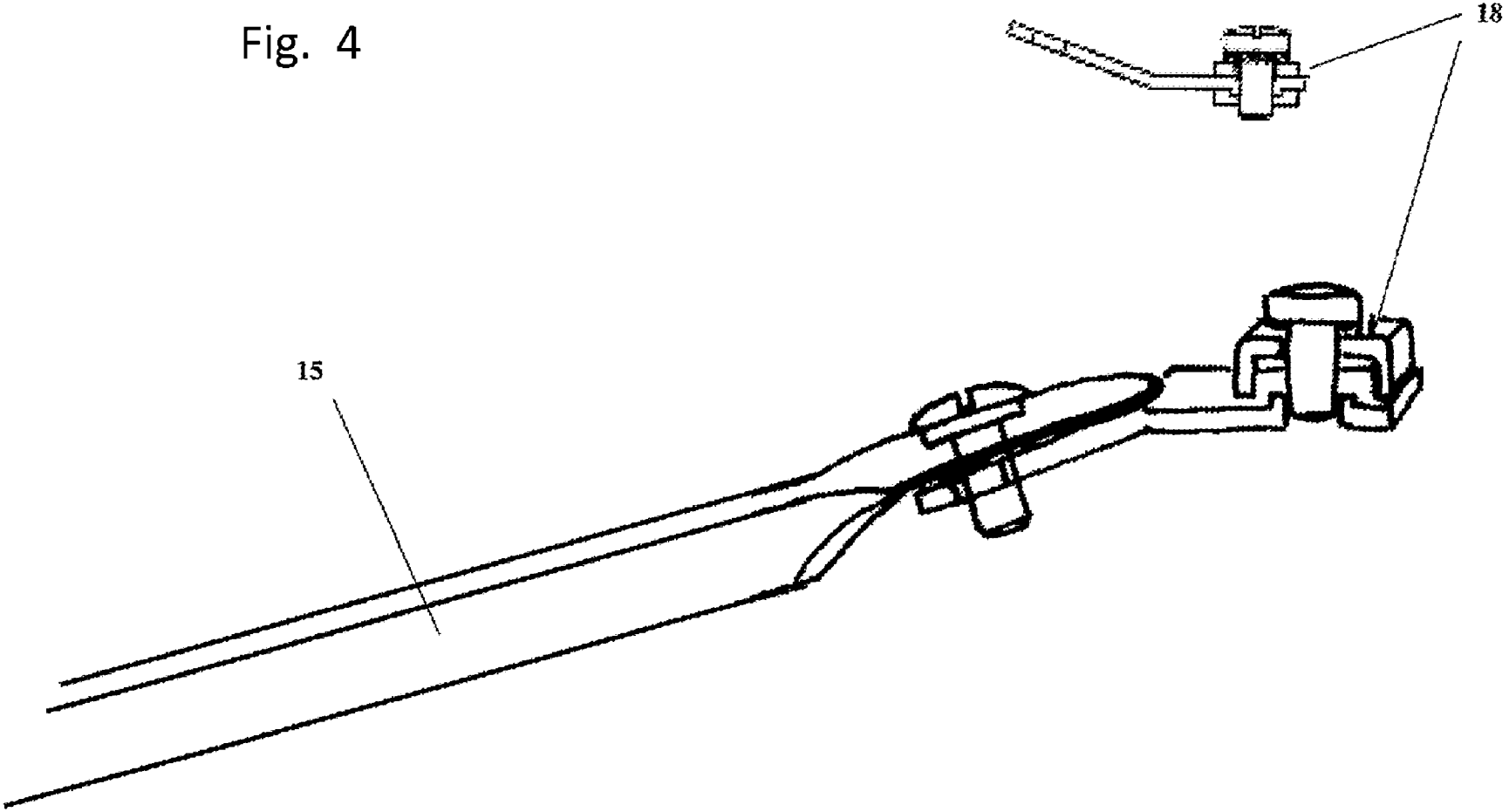

The holders (36) which are presented in FIG. 7 and which hold the diaphragm described in FIG. 1 are attached to the abovementioned basic structure.

As is apparent from FIG. 7, the holder (36), owing to the notch (37), is also a guide rail for the "stopper" (8) and prevents the catch and lobbying structure explained from slipping to and from and also the diaphragm from opening up forward. Since the holders for the diaphragm can strike together when the latter is being snapped shut, there is also the possibility of producing the holders from a material which, upon the abovementioned snapping shut, produces, for example, a clicking noise. In principle, it is envisaged laminating the holders (and stopper), but there is also the possibility of producing a noise when snapping the diaphragm shut.

Figure 8:
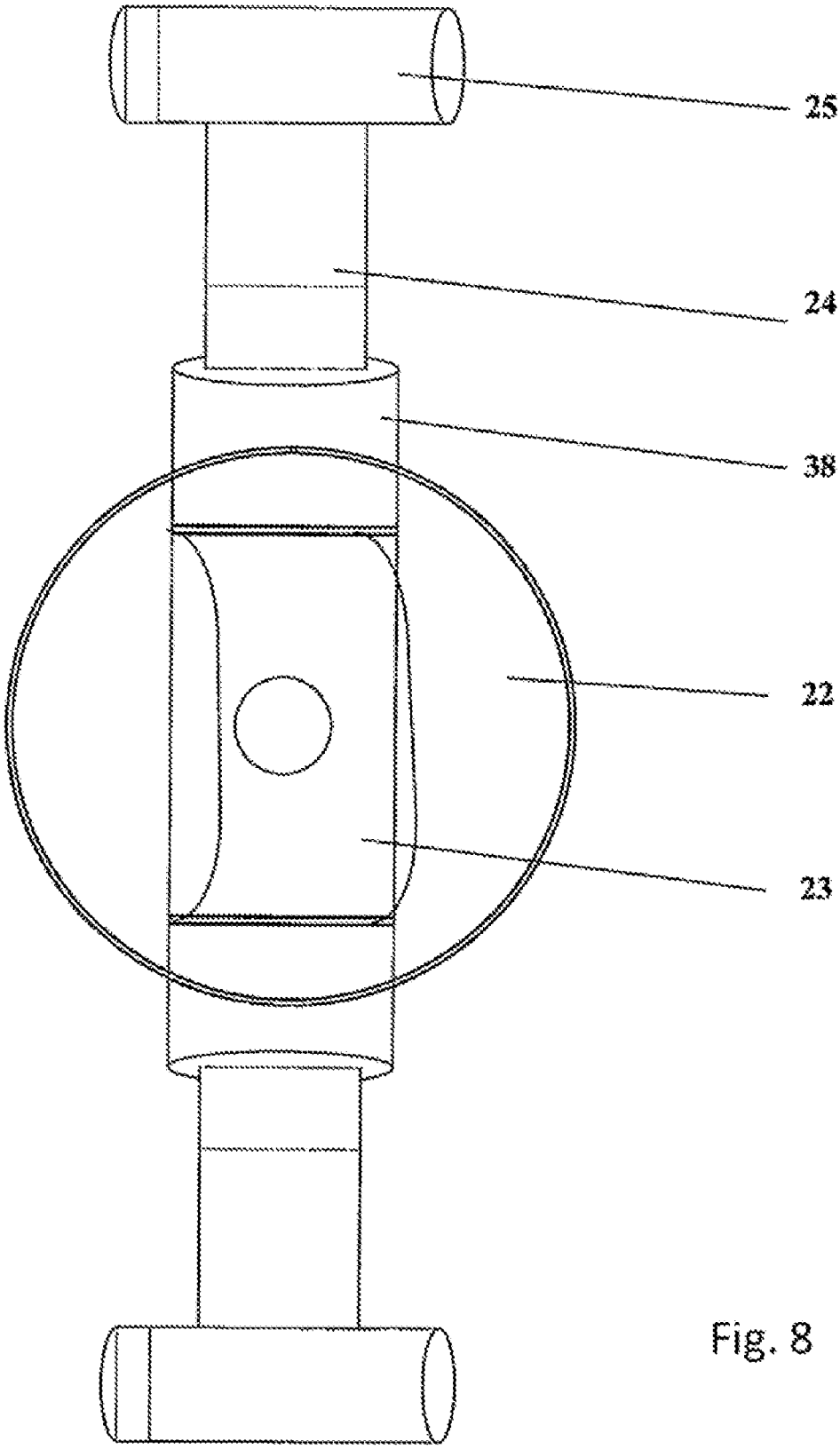

FIG. 8 shows a detailed view of the thumb holder for the second embodiment.

The invention claimed is:

1. A play and sport device for catching and shooting a flying object, comprising:

a pair of ring members each having an outer periphery and an interior region which is at least partial open, the rings pivotally connected to one another along a hinge axis and movable about the hinge axis between a closed position in which the rings overlie one another and an open position in which a distal region of the rings opposite the hinge are spaced apart;

a pair of tubular handles, one located on each of the rings and spaced from the hinge axis for receiving the thumb and opposed fingers of the hand of a user, enabling the user to manually open and close the rings; and a diaphragm assembly formed of a sheet of flexible material having an outer peripheral edge to which has attached two spaced apart peripheral frame segments which define therebetween a transverse fold line to allow the diaphragm assemble to be folded in half upon its self, each of the peripheral frame segments being attached to the distal region of one of the ring members so that the diaphragm folds closed when the rings are in the closed position and the diaphragm is stretched between the frame segments attached to the spaced apart distal regions of the rings in the open position;

wherein a flying object can be caught and retained within a pocket defined by the diaphragm assembly when the user moves the rings to the closed position, and shot from the device when the user's hand, with a thumb and opposed fingers inserted within the tubular handles, is rapidly opened causing the diaphragm assembly to move to the taut state spanning between the spaced apart distal ends of the open rings.

2. The play and sport device of claim 1 wherein the pair of ring members are generally flat and engage one another along a common plain in the closed position.

3. The play and sport device of claim 1 wherein the pair of ring members in the closed position form a generally circular assembly.

4. The play and sport device of claim 1 wherein the partially open interior region of the pair of rings is semi-circular in shape and located proximate the distal region of the rings.

5. The play and sport device of claim 1 wherein pair of tubular handles further comprise straps sized to engage the thumb and the opposed fingers of the user.

6. The play and sport device of claim 5 wherein the straps are adjustable to accommodate hand of the user.

7. The play and sport device of claim 1 wherein diaphragm assembly is generally circular in shape when in the open position.

8. The play and sport device of claim 7 wherein the two spaced apart peripheral frame segments are semi circular in shape.

9. The play and sport device of claim 1 wherein diaphragm assembly and pair of rings strike together when the device is snapped closed by the user.

10. The play and sport device of claim 9 wherein the device makes a clapping noise when snapped closed by the user.

* * * * *